US008158000B2

(12) United States Patent
Newman et al.

(10) Patent No.: US 8,158,000 B2
(45) Date of Patent: Apr. 17, 2012

(54) SYSTEM AND METHOD OF SEPARATING HYDROCARBONS

(75) Inventors: Paul Newman, Bedford (CA); Christian Nilsen, Houston, TX (US)

(73) Assignee: M-I LLC, Houston, TX (US)

( * ) Notice: Subject to any disclaimer, the term of this patent is extended or adjusted under 35 U.S.C. 154(b) by 724 days.

(21) Appl. No.: 12/337,419

(22) Filed: Dec. 17, 2008

(65) Prior Publication Data

US 2009/0156877 A1 Jun. 18, 2009

Related U.S. Application Data

(60) Provisional application No. 61/014,262, filed on Dec. 17, 2007.

(51) Int. Cl.
*B01D 12/00* (2006.01)

(52) U.S. Cl. ..... 210/322; 210/512.2; 210/513; 175/206

(58) Field of Classification Search ..... None
See application file for complete search history.

(56) References Cited

U.S. PATENT DOCUMENTS

| | | | | |
|---|---|---|---|---|
| 3,351,194 | A * | 11/1967 | Butler et al. | 209/5 |
| 3,875,046 | A | 4/1975 | Rosenbloom | |
| 4,039,425 | A | 8/1977 | Neavel | |
| 4,328,094 | A * | 5/1982 | Peck | 209/160 |
| 4,332,592 | A * | 6/1982 | Muller | 23/301 |
| 4,394,132 | A | 7/1983 | Taylor | |
| 5,234,577 | A | 8/1993 | Van Slyke | |
| 6,423,326 | B1 | 7/2002 | Shapiro | |
| 7,416,671 | B2 * | 8/2008 | Bozak et al. | 210/708 |
| 2006/0223714 | A1 | 10/2006 | Svoboda et al. | |
| 2006/0273855 | A1 | 12/2006 | Matsui et al. | |
| 2007/0111902 | A1 | 5/2007 | Patel | |

FOREIGN PATENT DOCUMENTS

| | | | |
|---|---|---|---|
| CA | 1302327 | C | 6/1992 |
| CA | 2567644 | A1 | 5/2007 |

OTHER PUBLICATIONS

International Preliminary Report on Patentability and Written Opinion issued in corresponding International Patent Application No. PCT/US2008/084364; Dated Jun. 10, 2010 (6 pages).

(Continued)

*Primary Examiner* — Tam M Nguyen
(74) *Attorney, Agent, or Firm* — Osha Liang LLP

(57) ABSTRACT

A system for separating hydrocarbons from a solid source, the system including a mixer configured to produce a slurry including the solid source and a liquid, and a first separator in fluid communication with the mixer, the first separator configured to separate hydrocarbons from the slurry. Additionally, a second separator include communication with the first separator, the second separator configured to receive the slurry from the first separator and separate additional hydrocarbons from the slurry, and a separation vessel including a hydrocarbon remover in fluid communication with the first and second separators, the separation vessel configured to receive the separated hydrocarbons and remove residual liquid from the hydrocarbons. Further including a collection vessel configured to receive hydrocarbons from the separation vessel, and a fine particle separator in fluid communication with the separation vessel, the fine particle separator configured to process residual liquid to produce cleaned liquid and residual solids.

13 Claims, 2 Drawing Sheets

OTHER PUBLICATIONS

PCT Notification of Transmittal of the International Search Report and The Written Opinion of the International Searching Authority, or the Declaration for PCT Application No. PCT/US2008/086141, dated Apr. 30, 2009, (4 pages).
Written Opinion of the International Searching Authority for PCT Application No. PCT/US2008/086141, dated Apr. 30, 2009, (4 pages).
International Search Report for PCT Application No. PCT/US2008/086141, dated Apr. 30, 2009, (3 pages).
Examination Report issued in corresponding British Application No. GB1011940.2; Dated Oct. 27, 2011 (2 pages).
Official Action issued in corresponding Mexican Application No. MX/a/2010/006655; Dated Nov. 10, 2011 (4 pages).

* cited by examiner

SYSTEM AND METHOD OF SEPARATING HYDROCARBONS

CROSS-REFERENCE TO RELATED APPLICATIONS

This application, pursuant to 35 U.S.C. §119(e), claims priority to U.S. Provisional Application Ser. No. 61/014,262 filed Dec. 17, 2007. That application is incorporated by reference in its entirety.

BACKGROUND

1. Field of the Disclosure

Embodiments disclosed herein relate generally to systems and methods of processing hydrocarbon laden solid sources. More specifically, embodiments disclosed herein relate to systems and methods of separating bitumen hydrocarbons from mined oil sand, rocks, and clay. More specifically still, embodiments disclosed herein relate to systems and methods of separating bitumen hydrocarbons from cuttings produced during drilling operations.

2. Background Art

Throughout the world, considerable oil reserves may be found locked in the form of tar/oil sand, also known as bitumen sand. Bitumen, which is a viscous hydrocarbon, is trapped between the grains of sand, clay, and water. Because the recovery of bitumen from the sand may provide an increasingly valuable commercial energy source, processes for extracting and refining bitumen have long been investigated.

One method for recovering tar sand is by mining. In these operations, surface or shallow oil sands are open pit mined. The cost of mining increases with the depth of burial of the formation. At some point, the amount of overburden and the cost of its removal becomes too great. These deeper deposits have recently begun to be exploited by drilling wells through the overburden. In some cases, the bitumen behaves as a fluid under reservoir conditions, and may flow into the well for production by conventional means. However, in other cases, the bitumen is either too viscous or is too solidified, and may not flow. To recover these deposits, steam or other heat sources may be introduced into the tar sand formation to liquefy the bitumen. Recently, a technique of drilling closely spaced horizontal wells that allow a controlled passage of steam therebetween has become popular. After months of steaming, the molten tar flows into collection wells for recovery. So-called Steam Assisted Gravity Drainage is one such technique.

In Alberta, the tar sands underlie a wide expanse of undeveloped and environmentally sensitive areas in the north of the province. Drilling wells inevitably creates large amounts tar sand cuttings. Currently, tarred cuttings must be hauled to either existing mining operations or permitted disposal sites. Therefore, processes that separate tar from sands at the drill site and allow delivery of sands clean enough for on-site disposal may reduce the cost of drilling.

Similar problems may occur when attempting to remove tar from drilled cuttings as those encountered when trying to recover tar from mined sand. However, when removing tar from drilled cuttings, surfactants, substances present in drilling fluid, and substances otherwise used to facilitate tar removed during the drilling process may contaminate the drilled cuttings. Such substances and surfactants may cause environmental concerns if not removed from the drilled cuttings prior to disposal.

Such processes as those mentioned above have not facilitated the efficient extraction of bitumen oil from oil sands. The aforementioned processes either haven't been adopted by the industry due to the fact that they substantially increase the cost of bitumen extraction, or have been adopted but result in high levels of hazardous waste product. Accordingly, there exists a need for a process that increases the production of bitumen oil from oil sand, while decreasing levels of hazardous waste and producing substantially cleaner sands.

In addition to mining oil sand, cuttings produced during drilling in locations containing oil sand may result in cuttings including sand, bitumen, and drilling fluid. Typically, such produced cuttings are stored in bins at the rig site, and blended with materials such as sawdust, prior to treatment at a centralized disposal facility. Further blending may allow the sand to be disposed or re-used, while blending with soil may allow for land disposal or use in the construction of roads and/or drilling pads.

Accordingly, there exists a need for systems and methods for separating hydrocarbons from oil sand and cuttings.

SUMMARY OF THE DISCLOSURE

In one aspect, embodiments disclosed herein relate to a system for separating hydrocarbons from a solid source, the system including a mixer configured to produce a slurry including the solid source and a liquid, and a first separator in fluid communication with the mixer, the first separator configured to separate hydrocarbons from the slurry. Additionally, a second separator include communication with the first separator, the second separator configured to receive the slurry from the first separator and separate additional hydrocarbons from the slurry, and a separation vessel including a hydrocarbon remover in fluid communication with the first and second separators, the separation vessel configured to receive the separated hydrocarbons and remove residual liquid from the hydrocarbons. Further including a collection vessel configured to receive hydrocarbons from the separation vessel, and a fine particle separator in fluid communication with the separation vessel, the fine particle separator configured to process residual liquid to produce cleaned liquid and residual solids.

In another aspect, embodiments disclosed herein relate to a method of separating hydrocarbons from a solid source, the method including mixing the solid source with a liquid to produce a slurry, and separating the slurry into hydrocarbons and a residual slurry by at least one of a group consisting of settling, floatation, mechanical agitation, circulation, aeration, and gravity separation. Additionally, separating the residual slurry into additional hydrocarbons and a solids phase through counter-current elutriation, removing residual liquid from the hydrocarbons and the additional hydrocarbons, and cleaning the residual liquid to remove fine particles.

Other aspects and advantages of the invention will be apparent from the following description and the appended claims.

DETAILED DESCRIPTION

Figure 1:
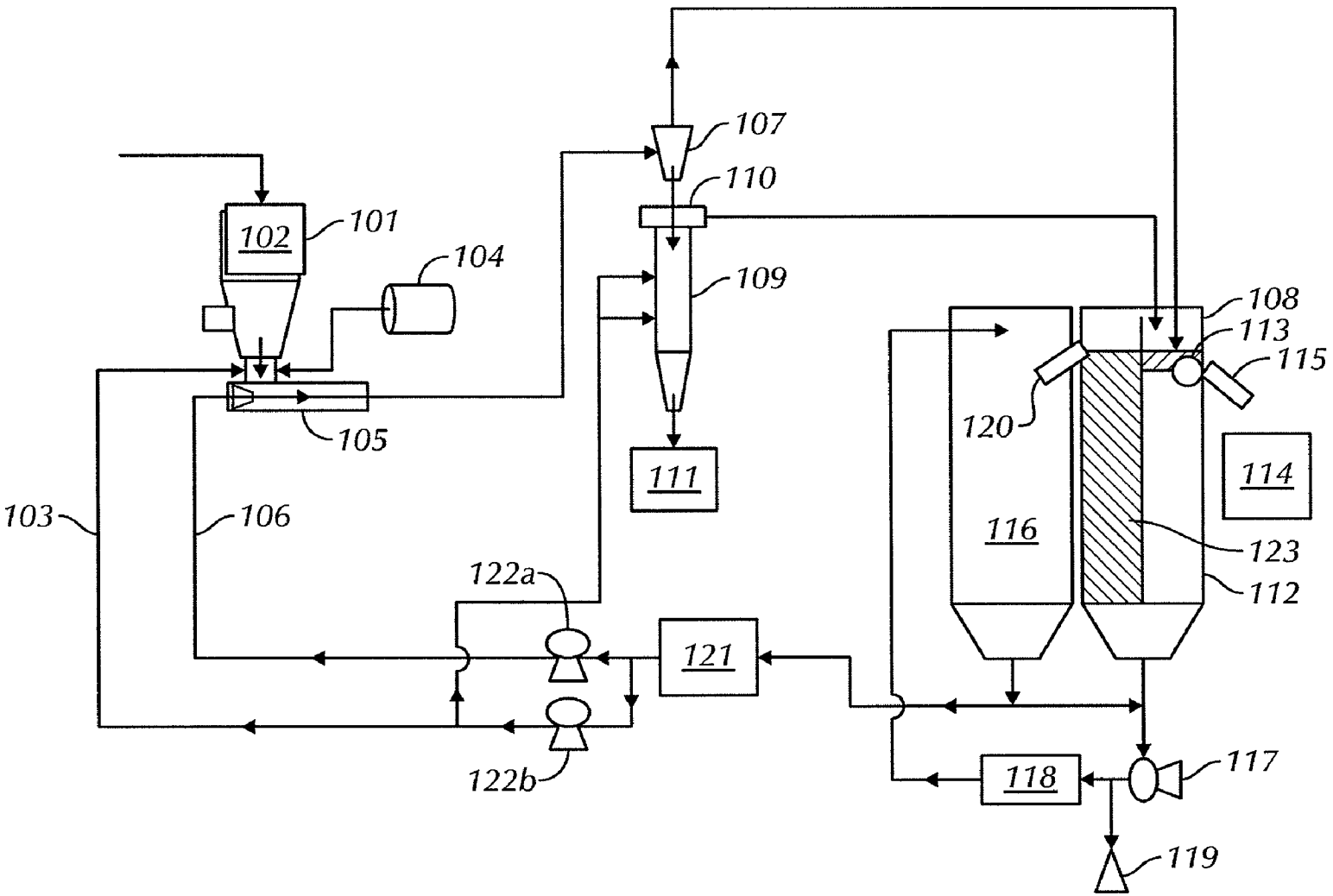
FIG. 1 is a schematic representation showing a system for separating hydrocarbons from a solid source according to an embodiment of the present disclosure.

In one aspect, embodiments disclosed herein relate generally to systems and methods for separating hydrocarbons from a solid source. More specifically, embodiments disclosed herein relate to systems and methods of separating hydrocarbons from oil sand and cuttings at a drilling location. More specifically still, embodiments disclosed herein relate to systems and methods of separating hydrocarbons in the form of bitumen from mined oil sand and drill cuttings at a drilling location.

Generally, during drilling of a well, drill cuttings are produced as a drill bit contacts formation. As drilling progresses, the drill cuttings are carried to the surface of the wellbore entrained in drilling fluids. At the surface of the wellbore, the drilling fluid, including the cuttings entrained therein, may be subjected to separatory operations, cleaning, and waste remediation, such that drilling fluids may be recovered for reuse in the drilling operation, while drilling cuttings may be disposed of. Typically, a primary separatory operation at a drilling location will include passing the drilling fluid over a separator, such as a vibratory shaker. During such a separatory operation, the drilling fluid flows over a vibratory shaker having a plurality of screens and filtering elements disposed thereon. As vibrations are imparted to the drilling fluid, a substantially liquid phase of the drilling fluid is allowed to pass through the screens of the vibratory shaker, while larger solid particles remain on the screen. Perforations in filtering elements of the screens of the vibratory shaker determine a maximum sized particle that may pass therethrough. As such, fine particles may pass with the liquid phase through the perforations in the screen. The liquid phase, including the fine particles, may then be collected for further treatment in secondary separatory operations, or may otherwise be recycled for use in other aspects of the drilling operation (e.g., the liquid may be treated and pumped back into the wellbore).

While the liquids may be reused in the drilling operation, the separated solid particles are typically either collected for eventual disposal, or otherwise treated using secondary separatory operations. Examples of secondary separatory operations may include additional vibratory shakers, centrifuges, hydrocyclones, thermal desorption units, and other methods of separating liquids from solids known in the art. The secondary separatory operations may thereby provide for the collection of additional liquid phase that may be reused in the drilling operation, as well as further cleaning the solid particles prior to disposal. Depending on the local regulations where the wellbore is being drilled, the solid particles may require cleaning, such that hydrocarbon and chemical levels of the solid particles are reduced to environmentally safe levels. For example, in certain locations, regulations may require that land disposal of the cuttings may only be allowed if the total petroleum hydrocarbon content is less than 0.1% by weight. Thus, decreasing the hydrocarbon levels of the solid particles may require multiple cleaning and remediation steps prior to disposal.

Those of ordinary skill in the art will appreciate that land disposal is only one method of disposing solid particles from a drilling location. Other methods may allow solid particles to be mixed with clean soil prior to land spreading, thereby allowing, for example, a total petroleum hydrocarbon content of less than 0.4% to be acceptable. In still other embodiments, a total petroleum content of less than 5.0% may be acceptable if the solids are used in industrial construction projects, such as in the construction of roads and/or drilling pads. Moreover, solids may require less treatment, or more treatment, depending on the locality of the drilling operation.

In addition to solid particles that are a waste product of a drilling operation, in certain operations, solid particles may be actively harvested to allow for the recovery of hydrocarbons therefrom. For example, as explained above, mined oil sand and solid particles created when drilling formation containing mined oil sand may result in solid particles containing high levels of hydrocarbons. Solid particles containing substantial quantities of hydrocarbons may thereby be actively harvested, and subjected to remediation, such that the solid particles are cleaned, while the hydrocarbons are collected. The recovered hydrocarbons may be added into the production train, thereby increasing recovery efficiency.

Those of ordinary skill in the art will appreciate that solid particles produced by drilling, mining, or as a byproduct of a drilling operation may result in solids having substantial quantities of hydrocarbons. Thus, embodiments of the present disclosure discussed in detail below may allow for the recovery of hydrocarbons from mined oil sands and/or drill cuttings. As used herein, the term "solid source" refers to oil sand, drill cuttings, and other solid particle present at a drilling location. Furthermore, "hydrocarbons" refers to any hydrocarbons at a drilling location, including hydrocarbons in the form of a tar, an oil, or more specifically, a bitumen oil.

Additionally, the systems and methods disclosed herein may be used as either a primary or secondary separatory operation at a drilling location. In other embodiments, the systems and methods disclosed herein may be used as a process independent from the separatory operations, and as such, may constitute systems and methods for recovering hydrocarbons during production of an oil well or during a mining operation independent from a drilling operation.

Referring to FIG. 1, a schematic representation of a system for separating hydrocarbons from a solid source is shown. In this embodiment, the solid source is transferred from another aspect of a drilling operation into a mixer 101. The solid source may be transferred from a primary or secondary operation, directly from the wellbore, from a mining operation, or from a storage facility. Mixer 101 may include a feed hopper 102 configured to receive the solid source and premix the solid source with a liquid. As such, mixer 101 may include one or more water injection ports (not shown) disposed integral to feed hopper 102 or at an outlet (not shown) of feed hopper 102.

Liquids mixed with the water source may include heated water, brine, or other solutions including chemical additives to further enhance the separation of hydrocarbons from the solid source. In certain embodiments the water may include water produced from other components of the system, such that the system includes a substantially closed-loop water cycle. In this embodiment water is transferred via water line 103 from another component of the system, and injected at the outlet of feed hopper 102. As the liquid and solid source mixes, a lurry is produced. The slurry may thus include a mixture of solids, liquids, and initially separated hydrocarbons. In certain aspects, the slurry may then be aerated via, for example, an air compressor 104. Air compressor 104 may thereby aerate the slurry, allowing microbubbles to flow through the liquids, thereby contacting the solids, and facilitating the separation of hydrocarbons therefrom. In certain embodiments, aeration and liquid additions may occur via a single device, such that steam is injected into mixer 102.

In this embodiment, the solid source is introduced into mixer 101 and diluted in a one-to-one ratio with heated water, such that hydrocarbons soften, and flowability of the slurry is increased. After mixing, the slurry is transferred from mixer 101 into an eductor 105, fluidly connected thereto. Eductor 105 may include, for example, jet pumps, venturi pumps, or other devices that create a pressure differential in a confined space, and may thereby draw in the slurry from mixer 101. In this embodiment, the pressure differential in eductor 105 is created by a flow of liquid from transfer line 106. In one aspect, the liquid in transfer line 106 may include a cleaned fluid from another component of the system. As such, the liquid may be heated prior to injection into eductor 105, thereby further increasing the separation of hydrocarbons in solid source in the slurry. Those of ordinary skill in the art will appreciate that eductor 105 may provide a method for controlling the addition of water to the slurry. Additionally, eductor 105 may provide for increased shearing of the slurry, thereby further helping to separate the hydrocarbons in the slurry. Because of the shearing, in aspects using heated water, eductor 105 may increase the rate of temperature increase of the hydrocarbon, thereby providing for greater gravity separation, which will be discussed in detail below. Those of ordinary skill in the art will appreciate that in alternate embodiments, eductor 105 may be substituted with another type of transfer pump. For example, in alternate embodiments, a centrifugal pump, dynamic shear mixing pump, static mixing pump, or other positive/negative displacement pumps may be used.

As the slurry flows into eductor 105, the slurry is energized, and may be transferred to a first separator 107. In this embodiment, first separator 107 is a hydrocyclone; however, those of ordinary skill in the art will appreciate that in alternate embodiments, first separator 107 may include any separator known in the art that allows for the separation of a solid from a liquid. For example, in alternate embodiments, first separator 107 may include a centrifuge. In this embodiment, the energized slurry is introduced into first separator 107, wherein the first separator 107 imparts centrifugal force to the slurry to separate the solid from the liquid. The overflow from the hydrocyclone contains primarily liquid and recovered hydrocarbons, while the underflow contains primary solids, as well as some residual hydrocarbons and liquid. The overflow is then transferred from first separator 107 into a separation vessel 108, which will be discussed in detail later.

The underflow is then transferred to a second separator 109 in fluid communication with first separator 107. In this embodiment, second separator 109 is an elutriation column; however, those of ordinary skill in the art will appreciate that in alternate embodiments, secondary separator 109 may include other types of gravity separation columns. As illustrated, secondary separator 109 includes a funnel 110, thereby allowing the transfer of the underflow from first separator 107 to enter secondary separator 109 at an optimal velocity. Depending on the viscosity of the slurry entering secondary separator 109, aspects of funnel 110 may be varied to achieve the optimal entry velocity. Examples of such aspects that may be varied include geometry, length, and diameter of funnel 110.

As the slurry flows from funnel 110 into the body (not independently numbered) of secondary separator 109, the slurry flows in a downward direction, while a flow of heated water in the body of the secondary separator 109 flows upward. As the heated water contacts the solids in the slurry, hydrocarbons separate from the solids, and flow upward, while solids settle toward the bottom of the body. Generally, the solids will flow down the body by passing down the outer boundary, where the upward water flow is negligible. As such, an overflow from the elutriation column primarily includes hydrocarbons and residual liquids, while an underflow includes primarily solids. Those of ordinary skill in the art will appreciate that in this embodiment, the design of secondary separator 109 affects the quantity of solids that flow into the overflow. By decreasing the quantity of solids entering the overflow from the elutriation column, hydrocarbon recovery may be increased as a result of the solids spending longer in the column.

In this embodiment, the efficiency of secondary separator 109 may be impacted by the design parameters of the elutriation column. Stokes Law state that the settling or terminal velocity of a particle is governed by the acceleration, particle size, density difference between solids and liquid phase, and the viscosity of the media:

$$V_s=(CgD^2(P_S-P_L))/\mu \quad (1)$$

where $V_s$ is the settling or terminal velocity in ft/sec; C is a constant, 2.15×10-7; g is the acceleration in ft/sec2; D is the particle diameter in microns; $P_S$ is the specific gravity of the solids; $P_L$ is the specific gravity of the liquids phase; and $\mu$ is the viscosity of the media in centipoise. Accordingly, if the water flow in the elutriation column causes the solid particles to rise at a velocity greater than the terminal velocity, then the particle will not settle in the column. By selecting the corrected sized column, the upward water flow rate can be controlled. Prior testing indicates that approximately 90% of the solids contained in the drill cuttings were 32 microns or larger in diameter, and therefore, the column may be designed such that the terminal velocity of the 32 micron particle is greater than the water rise velocity. As such, the solids may be eluted from the bottom of the column and conveyed out of the system.

Those of ordinary skill in the art will appreciate that the elutriation column may be designed for optimal hydrocarbon separation and solids drop out, and may be varied by adjusting design parameters of the column. Examples of such design parameters may include column circumference, length, inlet and outlet flow rates of the slurry, and inlet and outlet flow rates of the heated water. In addition to promoting the separation of hydrocarbons from the solids, the solids may be polished by the elutriation column, such that subsequent cleaning operations for the solids may not be required.

After the slurry is separated in secondary separator 109, the hydrocarbons and residual liquids overflow out of the separator, and are transferred to separation vessel 108. The underflow, including the solids, may then be removed from the secondary separator 109 using a transport device (not illustrated), such as an inclined auger, rotary airlock, slurry pump, or other devices known in the art for transferring a solid source. In one embodiment, after exiting secondary separator 109, the solids may be transferred to a tertiary separation device 111. Tertiary separation device 111 may include a vibratory separator, such as the vibratory separator described above. After the tertiary separation, the solids may be discarded, processed by additional cleaning operations, and any residual liquids collected in the separation may be added back into the system, or otherwise used in the drilling operation.

The overflow from secondary separator 109, including hydrocarbons and residual liquids is then transferred to separation vessel 108, along with the hydrocarbons transferred from first separator 107. Separation vessel 108 includes a first partition 112 including a hydrocarbon remover, in this embodiment a skimmer 113. As hydrocarbons and liquids enter separation vessel 108, the hydrocarbons tend to float on top of the liquid, while residual solids, such as fine particles, tend to settle out toward the bottom of separation vessel 109. Skimmer 113 may include any type of skimmer known in the art, including, for example, a drum skimmer, rotary skimmer, or disc skimmer. In this embodiment, skimmer 113 is a variable speed rotary skimmer. Skimmer 113 includes a hollow polyethylene drum to which hydrocarbons may readily attach. If necessary, the drum may be filled with a continuous flow of cold water to aid in the collection of hydrocarbons by increasing the viscosity of the hydrocarbons. After collection, the hydrocarbons are transferred to collection vessel 114 via discharge outlet 115.

Fine solids that settle toward the bottom of first partition 112 may then be removed from first partition 112 with a stream of water via a pump 117. In this embodiment, pump 117 includes a progressive cavity pump, but those of ordinary skill in the art will appreciate that other pumps, such as other types of positive displacements pumps, may also be used. The flow from pump 117 is transferred to a fine particle separator 118, in this embodiment, a decanter centrifuge. As the fine solid particles and liquids are processed by centrifuge 118, the fine solid particles are removed, and discarded 119, while the liquid is transferred back into second partition 116 of separation vessel 108. In other embodiments, fine particle separator 118 may include hydrocyclones, or other separatory devices capable of separating fine solid particles from a slurry.

Those of ordinary skill in the art will appreciate that prior to or contemporaneous with the processing of the slurry in centrifuge 118, chemical additives may be introduced to increase the removal of the fine solid particles and/or any residual hydrocarbons from the slurry. Examples of chemical additives that may be used generally include flocculants and coagulants that are well known in the art.

As the cleaned liquid exits centrifuge 118, the fluid is transferred into second partition 116 of separation vessel 108. Second partition 116 is divided from first partition 112 by a baffle 123. As such, cleaned liquid is allowed to flow from first partition 112 under baffle 123 and through a weir plate 120 to second partition 116. Second partition 116 may thus be used as a storage tank for process liquids to be used in other aspects of the system. Because second partition may be used as a storage tank, liquids used in the system may be reserved, thereby creating a substantially closed-loop water cycle. Those of ordinary skill in the art will appreciate that in alternate embodiments, multiple vessels may be used instead of a one vessel with multiple partitions. In such an embodiment, baffle 123 may only be disposed in a single vessel, and weir plate 120 may provide for a flow from the first vessel to a second vessel.

When additional liquid is needed for mixer 102, eductor 105, or second separator 109, water may be pumped from second partition 116 to a heating device 121. Heating device 121 may include a boiler or other device capable of heating a fluid to a specified temperature. The heated liquid may then be transferred to other components of the system via one or more pumps 122*a* and 122*b*. In this embodiment, pump 122*a* is a variable speed progressive cavity pump, and as such, may be used to pump heated liquid in a high pressure flow to eductor 105. The high pressure flow from pump 122*a* may thereby provide additional shearing in eductor 105, further increasing the separation of hydrocarbons from the slurry. In this embodiment, pump 122*b* may be any type of pump known in the art, that may provide a flow of heated liquid to mixer 101 and/or secondary separator 109. In certain embodiments pumps 122*a* and 122*b* may also be used to provide a flow of heated fluid to other components of the system, such as first separator 103, or tertiary separator 111.

Because the liquid cycle is substantially closed-loop, the liquid may be recycled through the system with increased efficiency. Additionally, the closed-loop cycle may allow an operator to monitor aspects of the fluid, such as temperature and pH. When adjusting aspects of the liquids in the system, an operator may adjust the temperature of the liquid according to, for example, the specific type of hydrocarbons being recovered. Those of ordinary skill in the art will appreciate that bitumen hydrocarbons have a greater density than water at 25° C., but a density less than water at 70° C. This is caused by the coefficient of expansion for bitumen hydrocarbons being greater than that of water. In certain embodiments, those of ordinary skill in the art will appreciate that to recover the greatest volume of hydrocarbons, the temperature may be varied between a range of, for example, 25° C. and 77° C. In still other embodiments, it may be beneficial to maintain a process temperature of between 65° C. and 77° C. Those of ordinary skill in the art will appreciate that in order to maintain a process temperature within the above identified range, it may be necessary to heat the liquid to, for example, about 90° C., prior to injection of the liquid into individual components of the system.

Other liquid parameters that may be adjusted include the pH of the liquids. Both acid and alkaline conditions may result in the emulsification of bitumen hydrocarbons from the solids such that liquids for the system may not be recoverable. Those of ordinary skill in the art will appreciate that the degree of liquid contamination may increase as liquids are recycled through the system, thereby increasing water viscosity and decreasing cleaning efficiency. Generally, keeping the pH about neutral may be sufficient to cause the demulsification of bitumen hydrocarbons. For example, in one embodiment, in terms of cleaning efficiency, at 77° C. and a pH of 7, flow rates of liquids through the system of up to 21.4 gallons/minute may be possible during hydrocarbon recovery. Increases in pH may result in greater hydrocarbon recovery; however, those of ordinary skill in the art will appreciate that a balance of temperature, pH, and flow rate will depend on the specific solid source being processed. In certain embodiments, adjusting a pH in a range of 5 to 11 may provide for increased recovery efficiency, while in other embodiments, a pH of about 7 may be optimal. Similarly, those of ordinary skill in the art will appreciate that different flow rates may be achieved depending on the balance of temperature, pH, and the solids being processed.

In certain embodiments additional components may be added to the system. For example, in one embodiment, the system may include a boiler that receives either process water from within the system or water from an external source. In such an embodiment, the boiler may produce steam, which may be injected to mixer 101, separation vessel 108, or secondary separator 109. The injection of steam may thereby increase the separation of hydrocarbons from the solid source.

EXAMPLES

A small scale system was designed to treat small batches of solids as a proof of concept for this technology. The solids were sourced from three different operations in Alberta, Canada (labeled A, B, and C) and from a Horizontal Directional Drilling ("HDD") operation. The composition of the samples received is given in Table 1:

TABLE 1

| Alberta SAGD Tar Sands Cuttings | | | | | HDD Tar Sands Cuttings | | | | |
|---|---|---|---|---|---|---|---|---|---|
| Sample ID | Depth, m | Water, vol % | Sand, vol % | Tar, vol % | Sample ID | Depth, m | Water, vol % | Sand, vol % | Tar, vol % |
| A1 | 747 | — | — | — | HDD1 | — | 19 | 80 | 1 |
| A2 | 865 | — | — | — | HDD2 | — | 21 | 78 | 1 |
| A3 | 1015 | — | — | — | HDD3 | — | 19 | 80 | 1 |
| A4 | 1180 | 8 | 15 | 77 | HDD4 | — | 20 | 79 | 1 |
| A5 | 1320 | 9 | 18 | 73 | HDD5 | — | 20 | 79 | 1 |
| B1 | 1007 | 11 | 11 | 78 | HDD8 | — | 36 | 58 | 6 |
| B2 | 1250 | 5 | 10 | 85 | HDD9 | — | 21 | 78 | 1 |
| C1 | 958-1020 | 11 | 6 | 83 | HDD10 | — | 22 | 77 | 1 |
| C2 | 1190 | 5 | 71 | 24 | HDD15 | — | 19 | 80 | 1 |
| C3 | 1250 | 20 | 0 | 80 | HDD17 | — | 22 | 77 | 1 |
| C4 | Not known | 5 | 91 | 4 | HDD18 | — | 32 | 64 | 4 |
| | | | | | HDD20 | — | 23 | 76 | 1 |
| C5 | Not known | 2 | 91 | 7 | | | | | |
| C6 | Not known | 5 | 95 | 0 | | | | | |
| C7 | 1321 | 11 | 11 | 78 | | | | | |
| C8 | 1329 | 7 | 10 | 83 | | | | | |

The majority of the Alberta solids had a high bitumen hydrocarbon content of 77-85% with solids content in the range of 6-20%. A few Alberta samples (C2, C4-6) contained a higher amount of solids (up to 95%) and low hydrocarbon content (0-7%). The HDD samples also typically contained low amounts of bitumen hydrocarbons, typically 1%. The high amount of solids present (61-80%) were fine silt, clay and mudstone. This data typifies the extreme variation on solids that the system must be able to process.

Tests to determine the optimal process flow rate were carried out. The flow through the eductor must be sufficient to pull the cuttings from the mixer into the treatment equipment, and as such, feed rates may vary depending on the specific gravity and viscosity. Solids with high bitumen hydrocarbon contents are very viscous, and the flow rate achievable for processing was low. Solids were processed at a range of flow rates, and visual observation of the overflow and underflow streams from the hydrocyclone and the elutriation column were noted. The settling velocity ($V_s$) as determined by Stokes Law is governed by acceleration, which is related to inlet flow rate. The cut point will improve as the flow rate and pressure into the hydrocyclone increases, resulting in finer solids discharged and cleaned through the elutriation column. Any benefit seen in cut point with increased flow rate however, will be counteracted by turbulence created at the elutriation column inlet. When this occurs, fine and clay particles present will not settle through the column and will overflow with the water into the separation tank. Process flow rates, therefore, are adjusted for each sample such that solids carried over into the process water was minimized, and settling of solids through the column was achieved. Treatment of the Alberta solids using the small scale equipment was conducted at system flow rates of 21.5 gallons/minute. Due to the fine solids present in the HDD cuttings, the flow rates had to be lowered to 15 gallons/minute for the majority of testing, to prevent solids carry over from the elutriation column.

Figure 2:
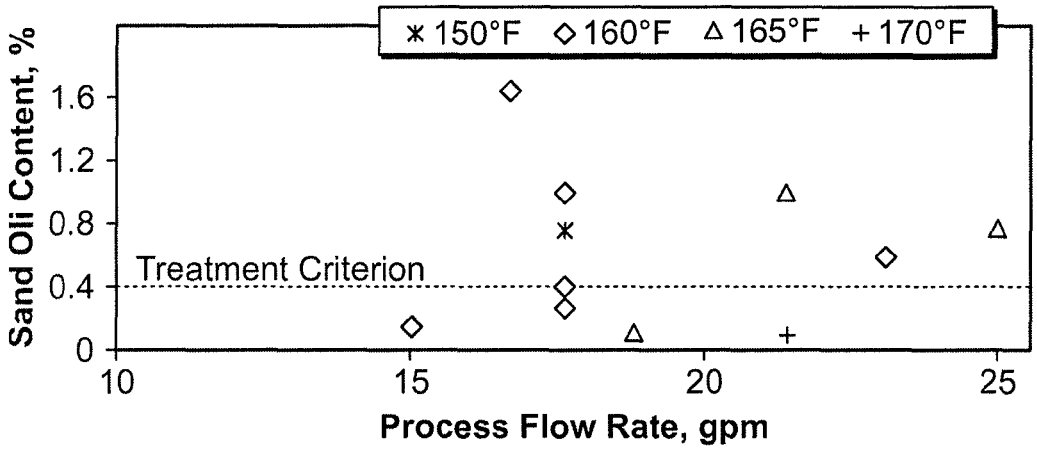
FIG. 2 is a graph showing hydrocarbon content as a function of flow rate according to an embodiment of the present disclosure.

Operation temperature is important as a driving force for bitumen hydrocarbon softening, thermal expansion, and flotation. If the processing temperature is too low, bitumen hydrocarbons will settle in the elutriation column with the solids. Therefore, when the temperature is too low, tar sands cleaning efficiency may be reduced. Using the Alberta solids with high bitumen hydrocarbon content, the process temperature was varied from 65° C. to 77° C., and hydrocarbon content of the cleaned Alberta solids was measured as a function of flow rate (FIG. 2). It can be seen that when the processing temperature is 65° C., flow rates less than 15 gallons/minute would be required to allow for sufficient residence time to adequately clean the sample and allow heat transfer. As the temperature of the process increased, the achievable flow rate while maintaining the oil content of the cleaned solids below the specification of 0.4% increased. At 71° C., flow rates less than 16.7 gallons/minute are required. At 74° C. the processing rate could be increased to 18.8 gallons/minute, and further to 21.4 gallons/minute as temperature increased to 77° C.

Figure 3:
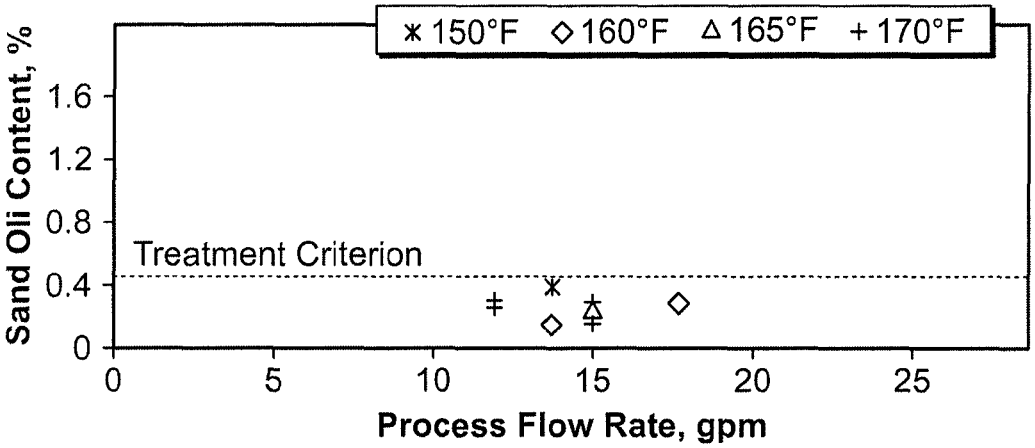
FIG. 3 is a graph showing hydrocarbon content as a function of flow rate according to an embodiment of the present disclosure.

The HDD samples were treated with the system at various temperatures between 65° C. and 77° C. Samples of the cleaned solids were analyzed by the Dean Stark method, as known to those of ordinary skill in the art, and FIG. 3 shows that under all treatment conditions, the samples had hydrocarbon concentrations well below the treatment requirement of 0.4%. The final data suggests cleaning of the HDD solids was easier than with the Alberta solids, and this may most likely be attributed to the low initial hydrocarbon content of these samples. The fines content of the solids meant that processing rate was lowered to 15 gallons/minute on average to prevent fines carry over from the elutriation column.

The above described examples are specific to the processing of bitumen hydrocarbons for both tar sand and drill cuttings. However, those of ordinary skill in the art will appreciate that the processes described with respect to the present disclosure are germane to the processing of solids from different aspects of drilling operations.

Advantageously, embodiments of the present disclosure may allow for an efficient method of processing solids containing hydrocarbons at a drilling location. Because the system uses a closed-loop liquid flow, liquids used in the system may be substantially recycled, thereby decreasing costs associated with adding replacement liquids, heating added liquids, or adjusting parameters of the liquids. Similarly, by having a closed-loop liquid flow, pH and temperature may be monitored, such that adjustment of the parameters may occur before problems arise.

Also advantageously, embodiments of the present disclosure may allow for the recovery of hydrocarbons from solids using primarily water to clean the solids. As such, the costs associated with hydrocarbon recovery may be reduced, because expensive chemical additives may be avoided. Additionally, by decreasing the need for chemical additives, the process is environmentally sensitive, thereby providing for an efficient method of cleaning solids at a drilling location in an environmentally sensitive area. Moreover, because the system may produce substantially cleaned solids, the discharged solids from the drilling location may be discarded at a drilling location with less environmental impact.

Advantageously, embodiments of the present disclosure may also provide for an efficient method of recovering hydrocarbons from solid drilling products that may otherwise go unused. By removing the hydrocarbons from the solids, solids that may otherwise be discharged, may result in additional hydrocarbon recovery, thereby increasing the overall production from the well.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A system for separating hydrocarbons from a solid source, the system comprising:

a mixer configured to produce a slurry comprising the solid source and a liquid;

a first separator in fluid communication with the mixer, the first separator configured to separate hydrocarbons from the slurry;

a second separator in fluid communication with the first separator, the second separator configured to receive the slurry from the first separator and separate additional hydrocarbons from the slurry;

a separation vessel comprising a hydrocarbon remover in fluid communication with the first and second separators, the separation vessel configured to receive the separated hydrocarbons and remove residual liquid from the hydrocarbons, a collection vessel configured to receive hydrocarbons from the separation vessel; and a fine particle separator in fluid communication with the separation vessel, the fine particle separator configured to process the residual liquid to produce cleaned liquid and residual solids.

2. The system of claim 1, further comprising:

a solid transporter in fluid communication with the second separator.

3. The system of claim 2, further comprising:

a vibratory separator configured to receive solids from the solid transporter.

4. The system of claim 2, wherein the solid transporter comprises at least one selected from a group consisting of an auger, a rotary airlock, and a slurry pump.

5. The system of claim 1, wherein the first hydrocarbon separator comprises a hydrocyclone.

6. The system of claim 1, wherein the second hydrocarbon separator comprises an elutriation column.

7. The system of claim 1, wherein the hydrocarbon remover comprises one selected from a group consisting of a drum skimmer, a rotary skimmer, and a disc skimmer.

8. The system of claim 1, wherein the mixer comprises:

a mixing vessel configured to receive the solid source; and an eductor in fluid communication with the mixing vessel and the first hydrocarbon separator.

9. The system of claim 1, wherein the mixer is configured to use the cleaned liquid in producing the slurry.

10. The system of claim 1, further comprising:

a heating device in fluid communication with the separation vessel and the mixer, wherein the heating device is configured to heat cleaned fluid from the separation vessel.

11. The system of claim 1, wherein the separation vessel comprises:

a first partition in fluid communication with the second separator, wherein the first partition comprises the hydrocarbon remover; and a second partition configured to receive a flow of liquid from the first partition.

12. The system of claim 11, wherein the separation vessel comprises a weir disposed between the first partition and the second partition.

13. The system of claim 1, further comprising:

an aeration device in fluid communication with at least one of the mixer and the second hydrocarbon separator.

* * * * *